US006332230B1

(12) United States Patent
Chang

(10) Patent No.: US 6,332,230 B1
(45) Date of Patent: Dec. 25, 2001

(54) TUB GRAB BAR STRUCTURE

(76) Inventor: Shih-Kuo Chang, No.71, Lane 54, Sec. 2, An Ho Rd., Tainan (TW)

( * ) Notice: Subject to any disclaimer, the term of this patent is extended or adjusted under 35 U.S.C. 154(b) by 0 days.

(21) Appl. No.: 09/828,989

(22) Filed: Apr. 10, 2001

(51) Int. Cl.[7] ..... A47K 3/02
(52) U.S. Cl. ..... 4/577.1; D23/303
(58) Field of Search ..... 4/577.1, 576.1, 4/571.1, 559, 578.1, 579; 294/16, 103.1; D23/303, 304

(56) References Cited

U.S. PATENT DOCUMENTS

D. 373,624 * 9/1996 Obitts .
D. 377,827 * 2/1997 Dhanapal et al. .
D. 380,530 * 7/1997 Stanton .
3,422,466 * 1/1969 Banoczi ..... 4/577.1
4,887,323 * 12/1989 DiVito et al. ..... 4/577.1
5,659,904 * 8/1997 Doczy et al. ..... 4/576.1

* cited by examiner

*Primary Examiner*—Charles R. Eloshway
(74) *Attorney, Agent, or Firm*—Rosenberg, Klein & Lee

(57) ABSTRACT

A tub grab bar structure comprises a clamping base comprising a fixed board substantially vertically disposed on a lateral side of a horizontal base body, the fixed board adapted to contact an outer tub surface; a threaded rod transversely disposed on the fixed board and including a knob at an end thereof for rotating the threaded rod; a clip board adapted to abut an inner tub surface, the clip board having a connecting rod substantially vertically attached thereto for receiving the threaded rod; a rotary horizontal baseboard pivotally coupled to the horizontal base body at a central pivot axis; a grab bar substantially vertically coupled to the baseboard; a tenon pipe substantially vertically disposed on the baseboard and radially spaced from the central pivot axis; an elastic bolt disposed inside the tenon pipe; and a plurality of insert holes radially spaced about the central pivot axis on the horizontal base body; wherein the elastic bolt is movable in the tenon pipe such that it is selectively engageable with any of the plurality of insert holes to adjust the angle of the grab bar with respect to the horizontal base body

1 Claim, 6 Drawing Sheets

TUB GRAB BAR STRUCTURE

BACKGROUND OF THE INVENTION

1. Field of the Invention

The present invention relates to a grab bar structure for a bathtub, more particularly to a structure of a tub grab bar that is readily installed to a bathtub with a rotary angle at the user's choice.

2. Description of the Related Art

A bathtub is the most important bath equipment, which is also a necessity for the current household life, and the tub usually occupies quite a space and is used very often. Generally, the tubs used in the past are laid with cement or ceramic tiles, and the later ones are integral products made of fiber glass or molded steel for better comfort and safety, and lately the present high-tech Jacuzzi is a symbol of high-quality life style. Because bathtubs are known to become slippery when wet, the tub needs a grab bar structure in addition to the slip proof structure at the bottom of the tub for the safety consideration. However, not every tub has a grab bar, and actually the early ones or the simple ones usually do not come with grab bars. Therefore, some industrial developers provide an accessory grab bar to be mounted on the side of the bathtub to help maintain balance while the user gets into or out of the bathtub, and more particularly such grab bar is commonly used by elderly persons, injured or infirm people.

In view of the present accessory tub grab bar products sold in the market generally have a clamping member at the bottom of a base body, and the grab bars are mounted onto the upper portion of the base body, and such device is clamped onto the lateral side of the bathtub by the clamping member and is used for grabbing as well as supporting a person's body weight. However, the grab bar usually comes with a certain angle regardless of its mounting vertically, transversally or in any other directions, and since it is integrated with the base body and the directional angle cannot be adjusted. Once if installed direction of the bathtub does not fit the grab bar, or the grab bar needs to be installed to another position for the user's special habit, such fixed tub grab bar will not be applicable. The use of such product in such situation cannot put the device in full play.

Since the traditional fixed grab bar is unable to adjust its directional angle, it is very inconvenient in use and difficult to gain popularity. The present inventor actively performed research and development in this area and expected to provide a better product for users' choice, and hence invents the present invention.

SUMMARY OF THE INVENTION

The primary objective of the present invention is to provide a tub grab bar structure that has a grab bar being disposed at the top section or the clamping base for changing its angle of position by rotation, and is capable of fitting in a broader application scope. Its basic structure comprises a fixed board being vertically disposed on a lateral side of a horizontal base body of a clamping base, a threaded rod being transversally disposed on the fixed board with a rotary knob at the exterior of the fixed board; and a clip board being coupled to a connecting rod which is vertically connected to the internal side of the fixed board; wherein a rotary horizontal baseboard being pivotally coupled to the horizontal base body of the clamping base; a grab bar being vertically coupled to the baseboard; a tenon pipe being disposed at the rotary diameter of the corresponding central pivotal axis; a plurality of insert holes being equidistantly disposed in a ring shape around the tenon pipe which is corresponsive to the horizontal base body of the clamping base; an elastic bolt being disposed inside the tenon pipe such that the elastic bolt is aligned and fixed into the insert hole. With such design, the grab bar can be rotated to change its angle and direction with respect to the clamping base by the baseboard, and hence be mounted onto a suitable position at the user's choice and also can fit different kinds of bath tub.

To make it easier for our examiner to understand the objective of the invention, its structure, innovative features, and its performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
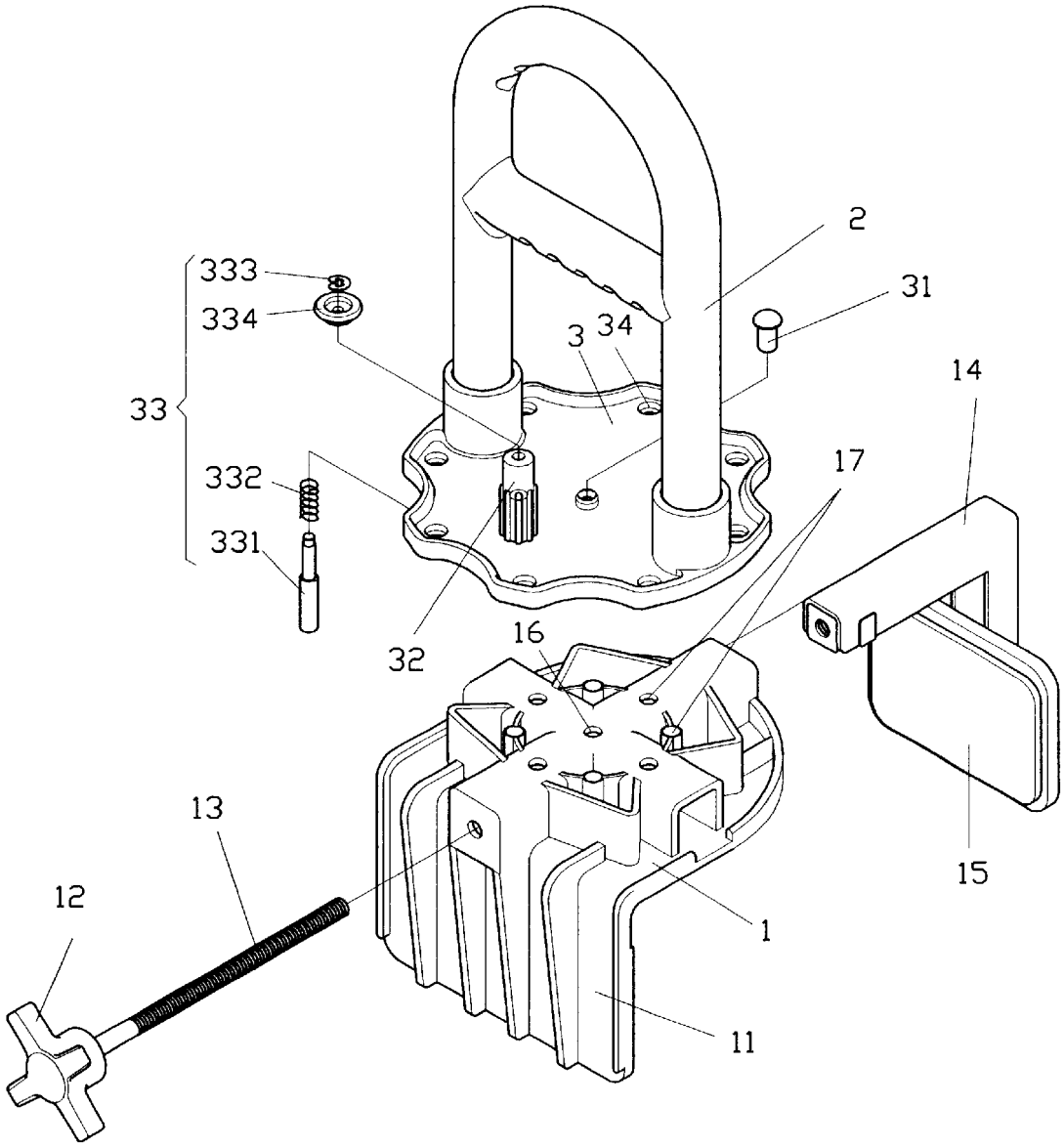
FIG. 1 is an exploded view of the tub grab bar structure of the present invention.
Figure 2:
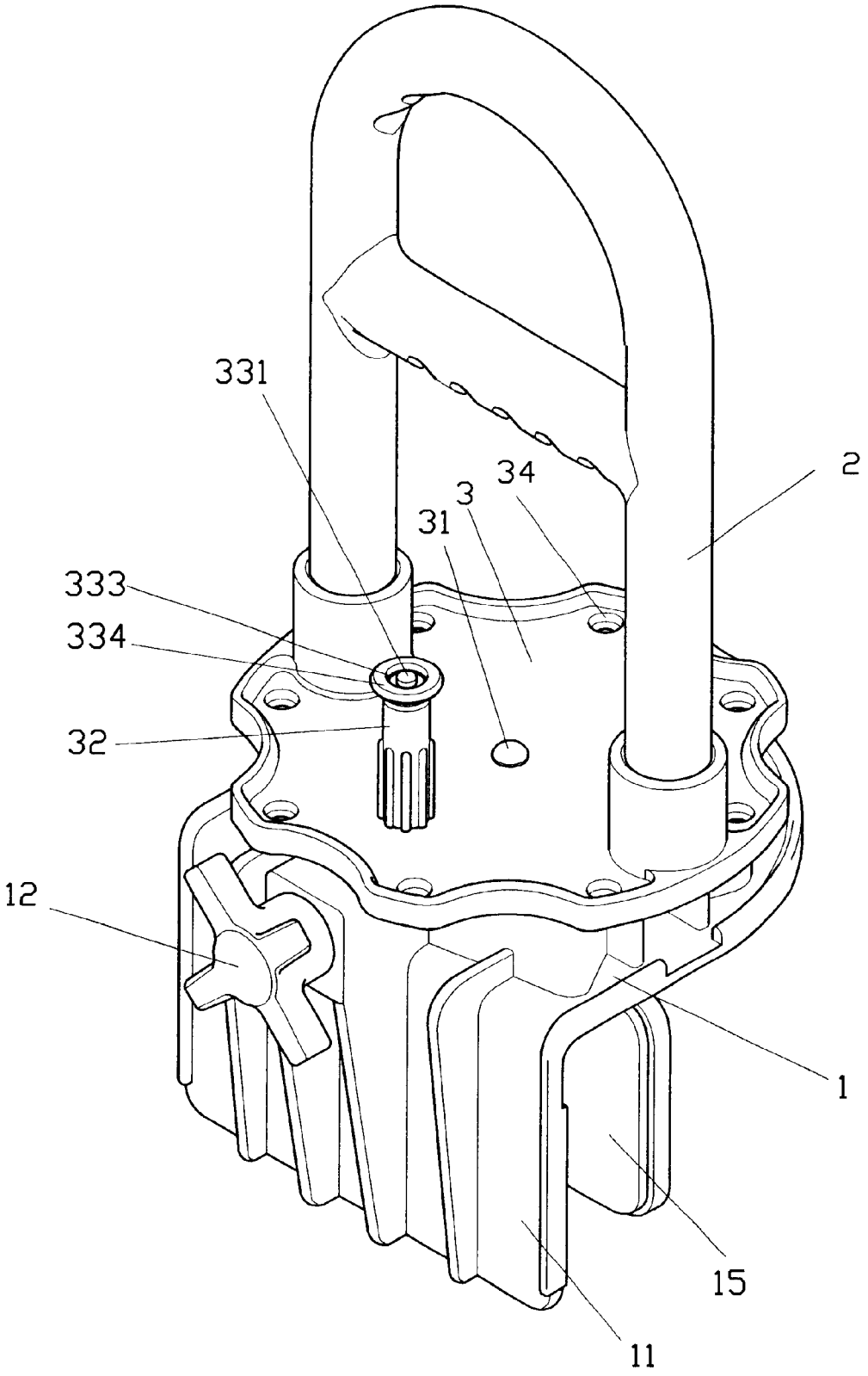
FIG. 2 is a perspective view of the assembled structure of the present invention.

In FIGS. 1 and 2, the clamping tub grab bar of the present invention has a grab bar (2) being disposed on the top of a clamping base (1). The grab bar (2) is coupled to a baseboard (3) so that it can rotate with respect to the baseboard.

The clamping base (1) is a base body in the shape of letter "L" positioned sideways comprising a fixed board (11) being vertically disposed on a lateral side of a horizontal base body of the clamping base (1), a threaded rod (13) being transversely disposed on the fixed board (11) with a rotary knob (12) at the exterior of the fixed board (11); and an L-shaped connecting rod (14) being coupled to the internal side of the fixed board (11) by the internal side of the threaded rod (13); and the lower end of the connecting rod (14) is connected to a clip board (15). A pivot hole (16) is disposed at the center of the horizontal base body for passing and pivotally coupling to a pivotal axis (31), and a plurality of equidistant insert holes (17) are arranged in a ring shape about the axis.

The grab bar (2) is vertically coupled to the baseboard (3). A tenon pipe (32) is disposed radially from the central pivotal axis (31). An elastic bolt (33) is disposed inside the tenon pipe (32). The elastic bolt (33) is sleeved with a spring (332) by an insert rod (331) together with a C-shaped buckle (333) that connects to a cap (334). In addition, a plurality of penetrating drainage holes (34) is around the periphery of the baseboard (3).

Figure 3:
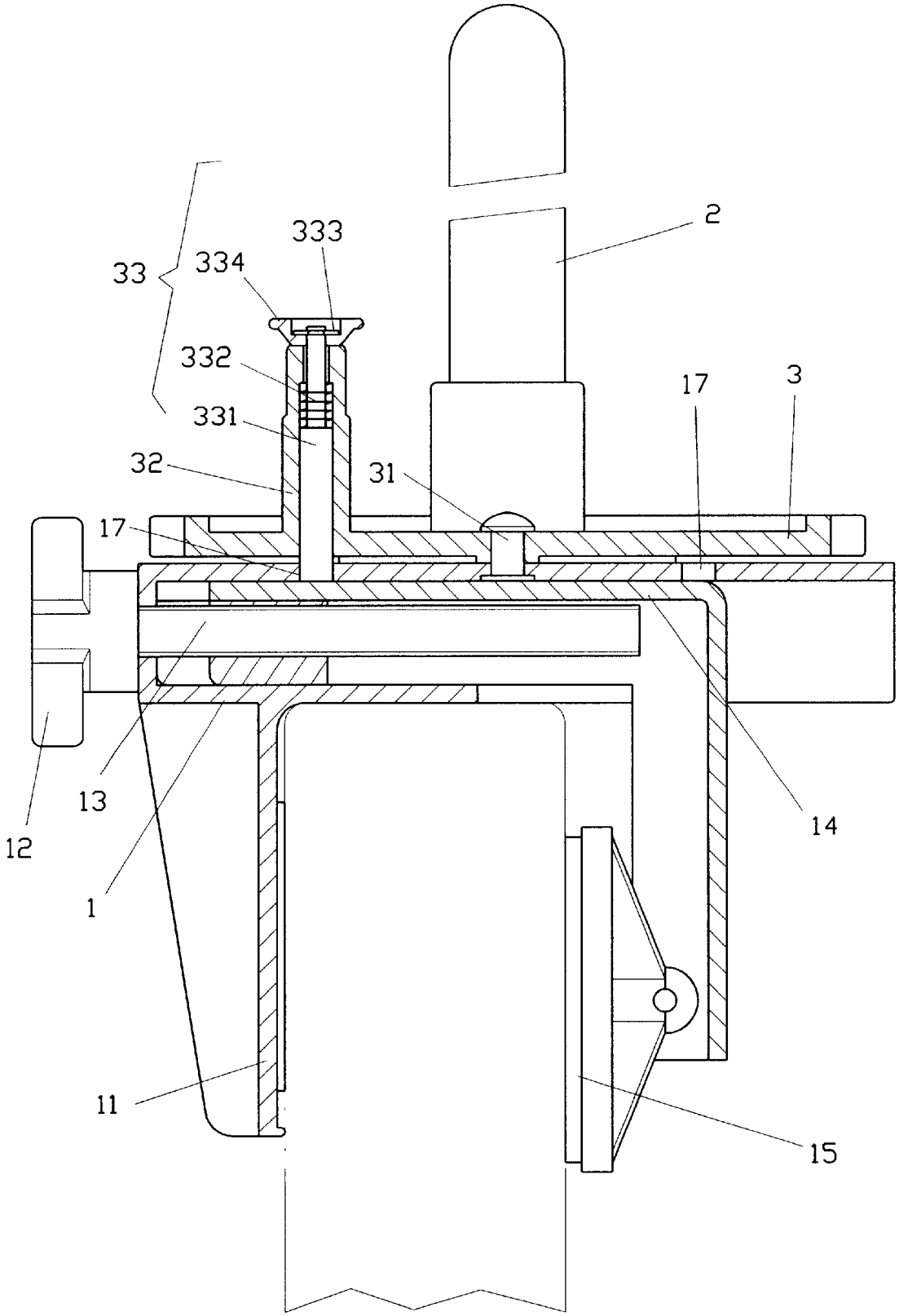
FIG. 3 is a cross-sectional view of the assembled structure of the present invention when it is in use.

By means of the assembly of the above components, as shown in FIG. 3, a transversely rotary structure can be assembled by pivotally coupling the pivotal axis (31) of the baseboard (3) to the screw hole (16) at the center of the horizontal base body of the clamping base (1). When it is fixed, the insert rod (331) of the elastic bolt (33) in the tenon pipe (32) on the baseboard (3) is pushed and latched into the insert hole (17) on the horizontal base body of the clamping base (1), which produces a fixing action and makes the grab bar (2) unable to rotate with respect to the clamping base (1) by the baseboard (3).

Figure 4:
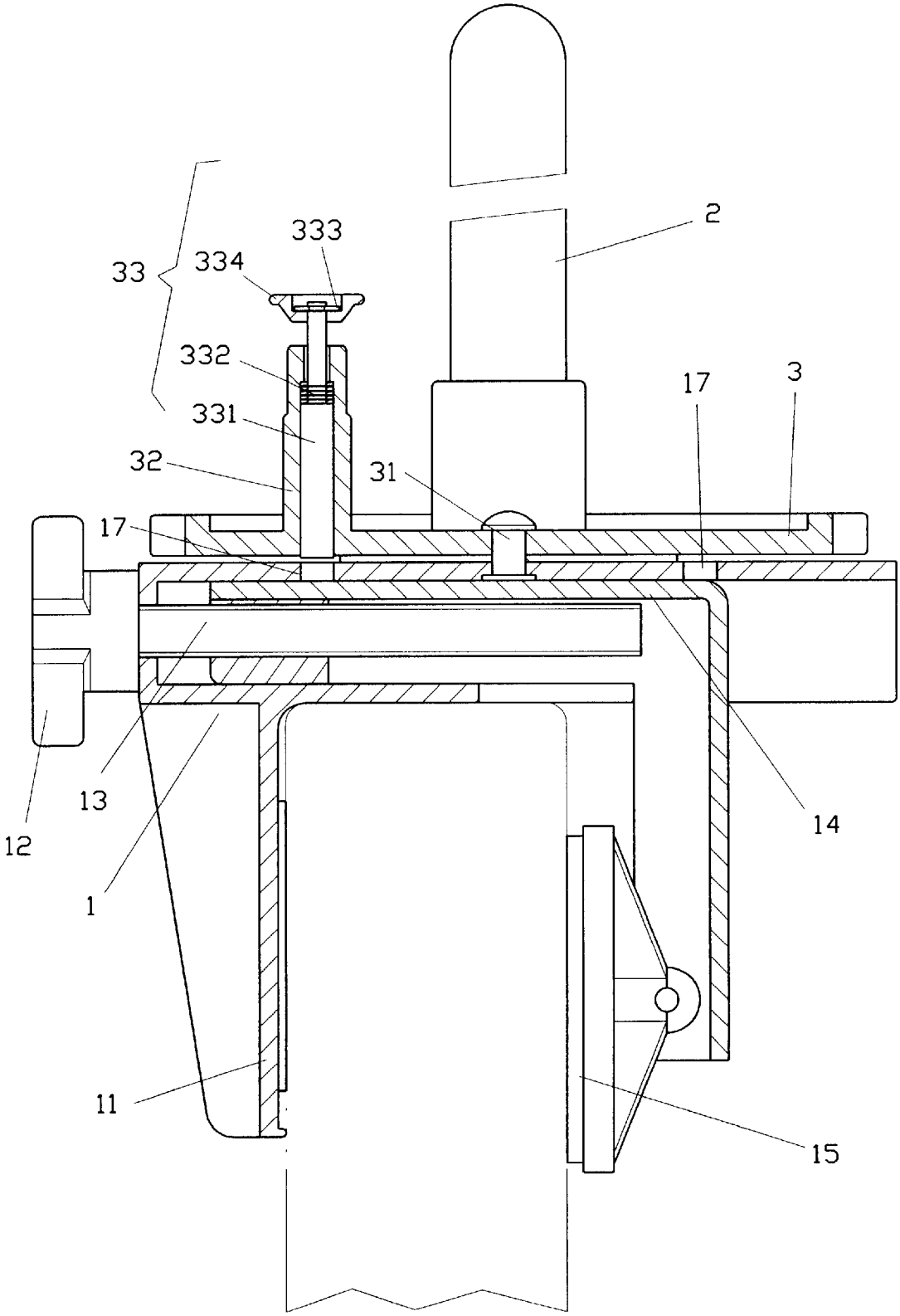
FIG. 4 is another cross-sectional view of the assembled structure of the present invention when it is in use.

Further, as shown in FIGS. 3 and 4, the grab bar according to the present invention can be clamped onto the inner and the outer sides of the bathtub by a fixed board (11) vertically deposed on the clamping base (1) and the clip board (15) connected to the connecting rod (14) which is vertically disposed on the inner side, and then by turning the rotary knob (12) at the external portion of the fixed board (11) to bring the threaded rod (13) together with the connecting rod (14) and the clip board (15) at the inner side in action clamping the fixed board (11) into position. By such arrangement, the grab bar (2) can be mounted onto the lateral side of the bathtub for users to hold and also to support their bodies.

Figure 5:
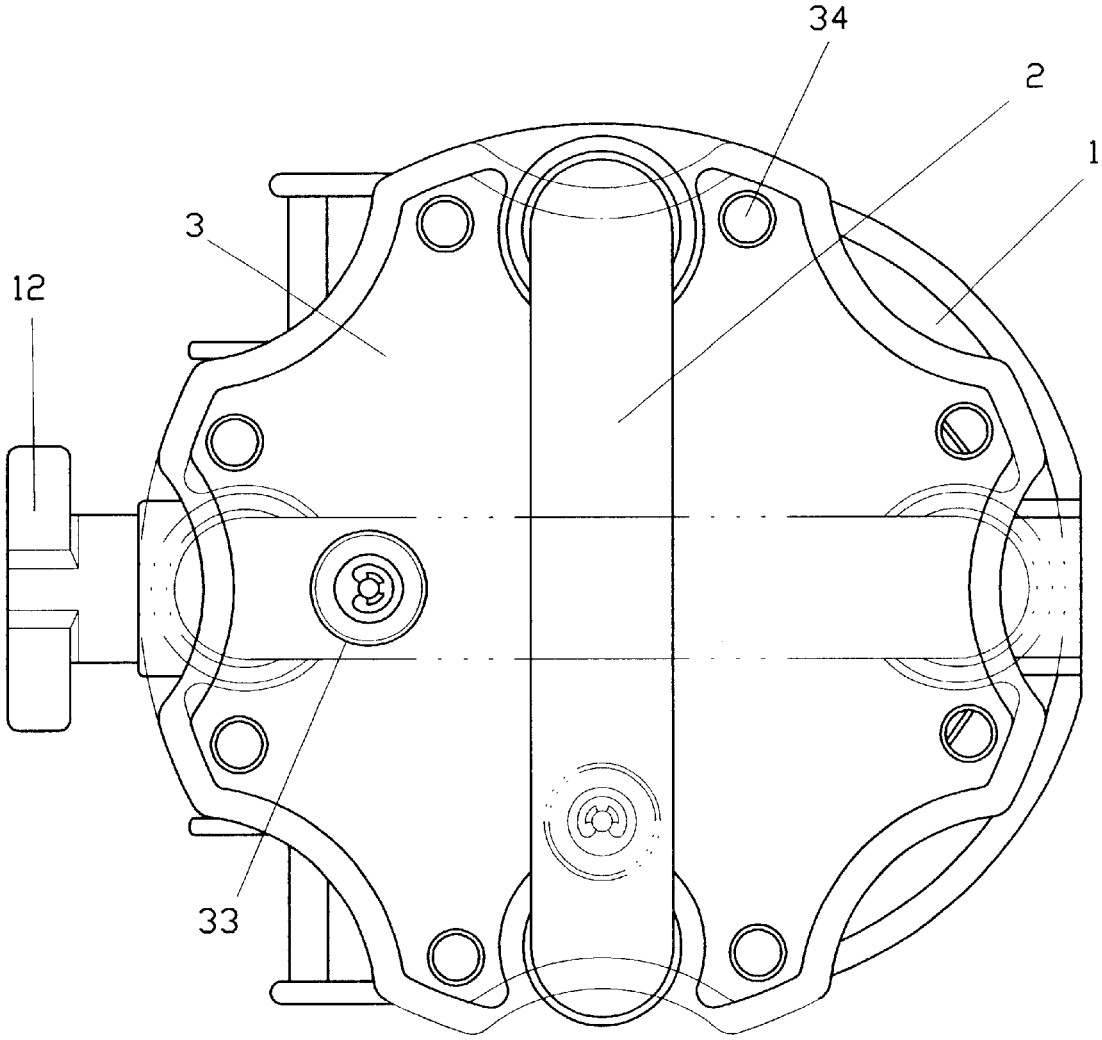
FIG. 5 illustrates the motion of unlocking the grab bar structure of the present invention.
Figure 6:
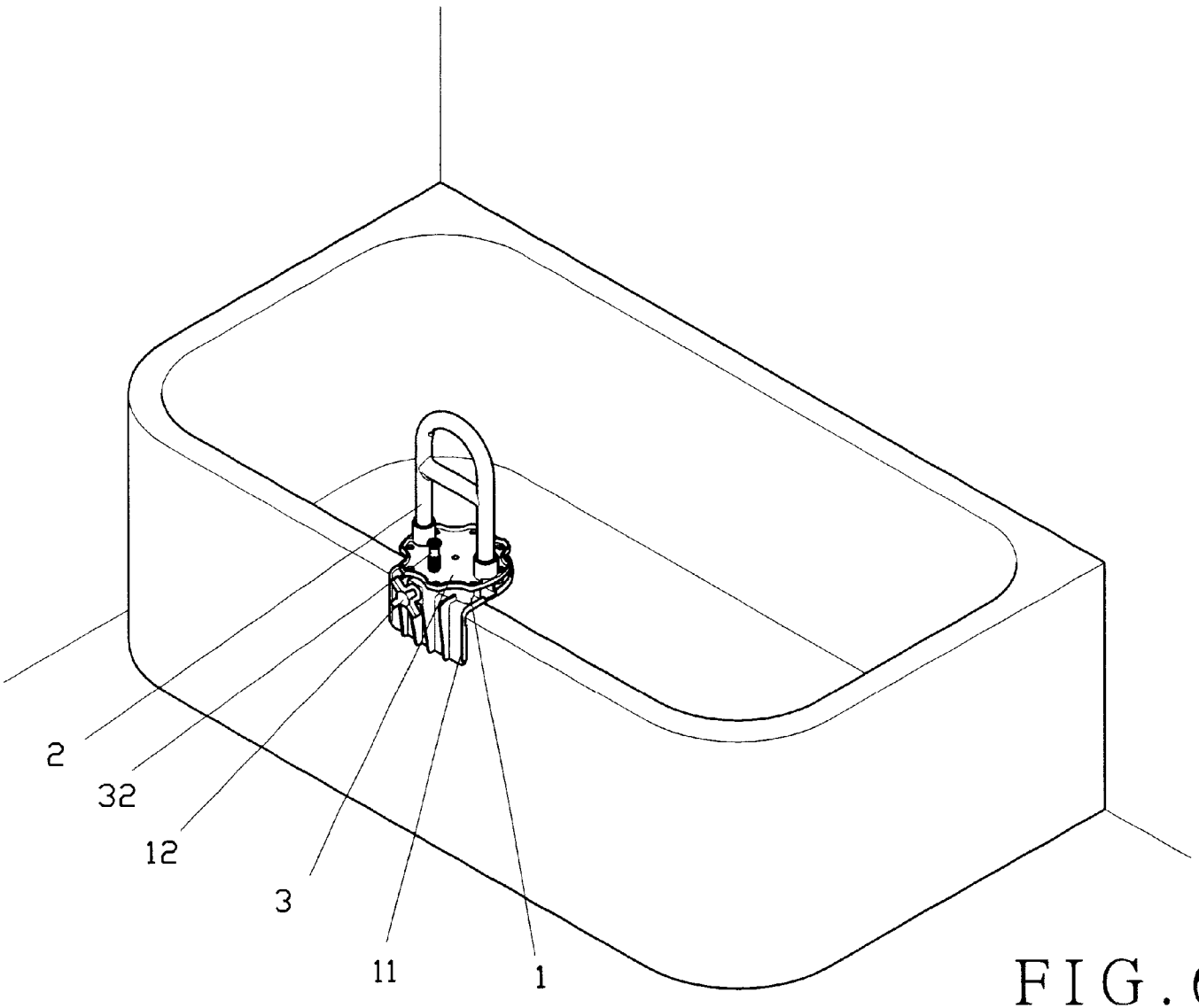
FIG. 6 illustrates the motion of rotating the grab bar structure of the present invention.

Further, to rotate the baseboard (3) with respect to the clamping base (1) in order to change the direction of the grab bar (2) at an angle that fits its use, as shown in FIG. 5, the user has to lift the elastic bolt (33) in the tenon pipe (32) of the baseboard (3) such that the insert rod (331) is detached from the insert hole (17) on the horizontal base body of the clamping base (1) to release the structure from fixing as shown in FIG. 6. Then the baseboard (3) with respect to the clamping base (1) can be shifted to change its angle of direction to align the insert rod (331) of the elastic bolt (33) with the insert hole (17) again for the fixing.

In summation of the above description, the tub grab bar structure according to the present invention herein enhances the performance than the conventional structure. It allows the grab bar at the top of the clamping base to rotate and change its angle of direction for a better use, and the installation operation is simple, secure, and much effective than the prior art devices.

What is claimed is:

1. A tub grab bar structure comprising:

a clamping base comprising a fixed board substantially vertically disposed on a lateral side of a horizontal base body, the fixed board adapted to contact an outer tub surface;

a threaded rod transversely disposed on the fixed board and including a knob at an end thereof for rotating the threaded rod;

a clip board adapted to abut an inner tub surface, the clip board having a connecting rod substantially vertically attached thereto for receiving the threaded rod;

a rotary horizontal baseboard pivotally coupled to the horizontal base body at a central pivot axis;

a grab bar substantially vertically coupled to the baseboard;

a tenon pipe substantially vertically disposed on the baseboard and radially spaced from the central pivot axis;

an elastic bolt disposed inside the tenon pipe; and a plurality of insert holes radially spaced about the central pivot axis on the horizontal base body;

wherein the elastic bolt is movable in the tenon pipe such that it is selectively engageable with any of the plurality of insert holes to adjust the angle of the grab bar with respect to the horizontal base body.

* * * * *